United States Patent [19]

Andresen, Jr.

[11] 3,975,703

[45] Aug. 17, 1976

[54] THERMOSTAT

[75] Inventor: John H. Andresen, Jr., Cayman Islands, British West Indies

[73] Assignee: E-P Products, Inc., New York, N.Y.

[22] Filed: May 6, 1975

[21] Appl. No.: 575,022

[52] U.S. Cl. ..... 337/374; 337/80

[51] Int. Cl.[2] ..... H01H 37/52

[58] Field of Search ..... 337/80, 331, 373, 374, 337/375, 369

[56] References Cited

UNITED STATES PATENTS

| | | | |
|---|---|---|---|
| 2,060,713 | 11/1936 | Wright et al. | 337/373 |
| 2,847,539 | 8/1958 | Pounds et al. | 337/374 |
| 2,901,577 | 8/1959 | Drummond et al. | 337/374 |
| 3,154,654 | 10/1964 | Woods et al. | 337/80 |
| 3,284,002 | 11/1966 | Edelman et al. | 337/373 |

*Primary Examiner*—Harold Broome

*Attorney, Agent, or Firm*—Ostrolenk, Faber, Gerb & Soffen

[57] ABSTRACT

A thermostat having a cover plate rotatable about a central horizontal support in which a bimetal or other thermally responsive member supported on the cover plate actuates a mercury switch also on the cover plate. This cover plate also has upon it indicia such as degree marks or simply arrows indicating "colder — warmer" operable against an imaginary vertical lubber line to indicate a setting. The need for time consuming and expensive levelling of the thermostat during installation is thus obviated because the thermostat is automatically levelled by the user as a result of setting the indicia in relation to the imaginary vertical line.

7 Claims, 5 Drawing Figures

THERMOSTAT

BACKGROUND OF THE INVENTION

The present invention relates to thermostats and more particularly to a novel form of thermostat for controlling the starting and stopping of a boiler, furnace, air-conditioner or for opening or closing of a zone valve for heating or cooling a building or a portion thereof.

Thermostatic temperature control is of course well known and is usually achieved by the mounting of a temperature responsive element on a wall in the area in which the heat is to be controlled, the temperature responsive element being so arranged that it will either open a circuit or close a circuit when a preset or selected temperature is reached. This, of course, is the type of operation which occurs in heating systems. The reverse type of operation may well be used in connection with air-conditioning or cooling systems.

The opening or closing of a circuit will then operate a particular heating unit in the case of temperature control under winter conditions; and, in the case of cooling systems, will operate particular valves in particular zoned areas of a building in order to achieve the desired cooling control.

Heretofore one of the problems in the arrangement of wall mounted thermostatic controls for temperature control systems is that the installation was required to be performed with accuracy and with a great deal of care, particularly in those instances where a mercury switch was used for such control. The levelling of the mercury switch type of thermostatic unit on the wall was extremely important to the accuracy of control and required extra installation time. This is because the calibration of the unit, with the lubber line stationarily mounted and the mercury switch rotatable, or vice versa, is gravity dependent and hence required careful levelling to assure that the set temperature and the control temperature were in fact the same. For example: a non-levelled thermostat might control at 80° F when set for 75°.

BRIEF SUMMARY OF THE INVENTION

The present invention contemplates the novel utilization of a rotatable member which constitutes the entire thermostat structure and indicia which appear to be simply the cover member therefor, but instead of reading the indicia against a stationary lubber line fixed to the wall, it reads against an imaginary vertical line.

The thermally responsive unit, which is most frequently a bimetallic member, and the mercury switch are both mounted on the rotatable cover member which has on it either a temperature scale with specific indicia in degrees or may simply have indicia without specific designations showing the direction for rotation for "warmer" and "cooler". Prior such thermostats have operated against a fixed lubber line. The rotation of what thus appears to the user to be the cover of the thermostat will actually constitute a rotation of the entire thermostat and therefore a setting thereof against an imaginary lubber line.

A base plate is provided which contains a bearing stud around which the entire thermostat may be rotated. The leads or connectors from the mercury switch are flexible wire connectors to terminal posts on the plate. The leads or connectors may be fed through the bearing stud itself. The plate is then secured to a wall and the leads from the mercury switch are connected in appropriate circuit arrangement to control the burner or the air-conditioner or a zone valve.

In a modified form the base plate may be provided with prongs which may permit it to be plugged into an electrical outlet which supplies the power through the thermostat to the heating or cooling device, with the power to the burner, the cooling device, or other heating exchange device under the control of the mercury switch.

The object of the present invention therefore is the provision of a novel thermally responsive control device in which the entire thermal unit containing the thermally responsive member and indicia as well as the switch which is controlled thereby is mounted in a rotatable member which contains all of the operating mechanism thereof so that rotation of this rotatable member with respect to an imaginary lubber line will result in setting of the thermostat for the desired temperature control location.

Another object of the present invention is the mounting in a thermostat of the type above set forth of all of the operating elements in a rotatable cover member including a mercury switch which may be used for control of the circuitry in response to the thermally responsive member carried by the thermostat.

A still further object of the present invention is to provide in a single thermally responsive unit elements which may be plugged into a power receptacle to provide appropriate power for either a burner or heat exchanger or air-conditioning device and in which the rotatable member which carries the thermally responsive member and the switch is utilized to control the circuit from the power source.

The foregoing and many other objects of the present invention will become apparent in the following description and drawings in which.

Figures 1, 2, 3, 4, 5:
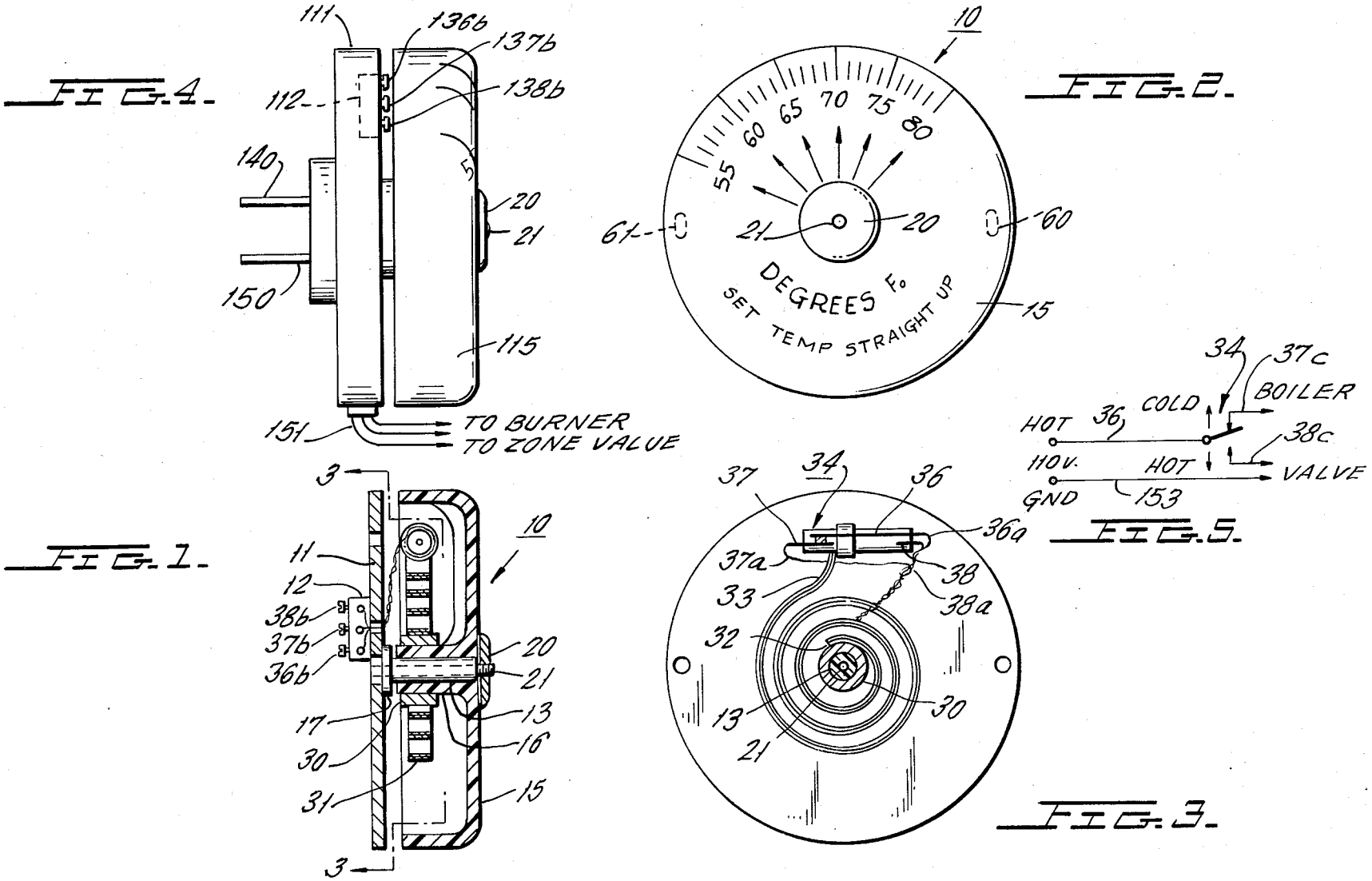
FIG. 1 is a view in vertical cross section of the novel rotatably settable thermostatic control of the present invention.
FIG. 2 is a view of the face of the thermostat of FIG. 1.
FIG. 3 is a front phantom view of the operating elements of the structure of FIGS. 1 and 2.
FIG. 4 is a view corresponding to that of FIG. 1 but showing a modification of the structure of FIG. 1 with respect to the method of mounting and the connection to the power source.
FIG. 5 is a schematic circuit diagram showing the operation of the thermostat of FIGS. 1 or 4.

Referring first to FIGS. 1 and 3, the thermostat 10 is provided with a stationary base plate 11 which carries a terminal block 12 and a fixed stud 13. Cover plate 15 has a bushing 16 which may be integral therewith and is rotatably mounted on the stud 13: cover plate 15 is of any suitable material including but not limited to plastic. An appropriate washer 17 is provided in order to space the bushing 16 as required from the base plate 11 and a nut 20 mounted on the threaded extension 21 of the stud 13 serves to secure the cover case 15 in place. A collet 30 pinned to the bushing 16 of the cover case 15 carries the bimetal coil 31, one end of the bimetal coil 31 being secured as shown to the said collet 30 at its inner end 32, the other end of the bimetal coil 33 being outwardly extended to carry the mercury switch 34.

In the mercury switch 34 the ground electrode is electrode 36.

Mercury switch 34 is so arranged that when the mercury switch 34 itself is rotated so that the electrodes 36 and 37 are connected by the pool of mercury, a circuit is closed to one element as hereinafter described and when the mercury switch is rotated in a clockwise direction to connect the electrodes 36 and 38 another circuit is closed as hereinafter described.

Where the switch is absolutely horizontal as shown in FIG. 3 neither the electrodes 36–37 nor the electrodes 36–38 are connected and the switch is open in mid position.

It will be seen however that as the temperature changes and the thermal element 33 uncoils owing to its structure then the end 33 of thermal element 31 will be rotated in a counterclockwise direction so that the mercury pool will connect electrodes 36 and 37.

As the temperature changes in the opposite direction and the member 33 moves clockwise the mercury switch 36 will move through the open circuit position and on further movement clockwise the electrodes 36 and 38 will be connected.

The electrodes 36, 37, 38 are connected by wires 36*a*, 37*a* and 38*a* to the terminal members 36*b*, 37*b*, 38*b* on the terminal block 12 of the base plate 11.

The terminals 36*b*, 37*b*, 38*b* may now be connected in circuit either with a relay control of line voltage to a burner or air-conditioner or the solenoid coil of a zone control valve or may be connected directly into the line voltage to provide control as hereinafter described in connection with the simple circuit diagram of FIG. 5.

In FIG. 2 the front view of the thermostat of the plastic thermostat case 15 is shown with appropriate indicia and instructions thereon. In this case it will be seen that no specific initial levelling of the entire unit is required in order to get an absolutely horizontal initial position of the mercury switch but that the case may be rotated after installation to obtain the setting.

The indicia provided on the case may be utilized against an imaginary lubber line or a marker may be extended from the base plate 11 to provide a reference point. It may also be preferred in this type of installation simply to have a two-headed arrow with the indicia "warmer" and "cooler" so that no specific temperature setting is provided. Although not shown, an appropriate thermometer may be provided on the base plate 11 or attached to the base plate 11 in order to provide an indication of room temperature at the thermostat area.

In FIG. 4 there is shown a modified form of structure in which the base plate 111 is provided with the cover plate 115; the plastic cover plate 115 has the construction already described in connection with the plastic cover plate 15 of FIGS. 1, 2 and 3 including the bimetallic thermally responsive member, the mercury switch, the indicia and the leads from the mercury switch to a terminal. In this case the base plate 111 is provided with a pair of prongs 140, 150 which may be plugged into an appropriate socket carrying line voltage. A terminal block 112 may be provided with the terminals 136*b*, 137*b*, 138*b* on the base plate 111 either in a position as shown or in any other appropriate position.

In this case the power for the air-conditioning or the heating unit can be obtained directly from the thermostat unit which is plugged into the power source and an appropriate cord may then extend from the thermostat unit as shown schematically at 151 of FIG. 4 to the heater or air-conditioner and/or zone valve.

As shown in FIG. 5 the power source is connected by the hot line to the electrode 36 of mercury switch 34. The mercury pool may then connect the hot line to either the boiler lead 37*c* or the zone valve lead 38*c* or may, when the mercury switch is absolutely horizontal, provide an open circuit. The return from either the boiler or the zone valve is then through the ground line 153.

It will thus be seen that a mercury switch type of bimetal controlled thermostat structure may be provided where the mercury switch will require no levelling and wherein the mercury switch constitutes a double pole structure which when rotated in one direction will close a circuit to for instance a heating device and when rotated away from that direction will open the circuit to the heating device and will, when rotated still further in the opposite direction, close the circuit to another device as for instance a valve.

By mounting the mercury switch on the casing which is adjusted by the user operating against an imaginary lubber line in order to determine the temperature setting, no special levelling of the mercury switch is required during installation.

In addition the present invention permits the thermostat to be mounted by plugging directly into a conventional wall outlet regardless of prong orientation; this is so since it is only the orientation of the plastic case with respect to an imaginary lubber line that actually matters. This structure simply requires that the leads 36, 37, 38 be sufficiently long to permit the desired rotation of the case 15 with respect to the base plate 11. It would even be obvious and possible, although not shown herein, to take the leads 36, 37, 38 from the mercury switch mounted on the plastic case through an opening in the bushing 16 and down through the center of the stud 13 where the stud 13 is made as a hollow stud. In this case there will still be some slack required in the leads 36, 37, 38 but not necessarily as much as in the case of the structure of FIG. 1.

The wall plate 11 may be mounted on the wall by means of mounting holes 60 and 61 indicated in phantom in FIG. 3; the installer should make certain to place the terminal block 11 on the upper side of the stud. Then the leads 36, 37, 38 need merely be long enough to take care of the full 90° to 120° angular adjustment which may be required.

Where in the case of FIG. 4 prong orientation and socket orientation may be such as to require an initial 90° variation in possible mountings the leads 36, 37, 38 must be long enough not only to take care of the 90° to 120°angular adjustment of the cover plate 15 but also of the additional 90° which may be required by reason of prong orientation. This makes it possible to adjust the unit for true operation whether the wall socket has vertical or horizontal slots.

In essence as above described the setting is made with respect to gravity; that is: vertical. In a level square room persons operating the thermostat can ascertain the vertical very closely with very little practice. It is essentially because the user of the thermostat performs this job of "levelling" rather than the installer that installation time is saved; accuracy depends on the user and not on the installer.

In the foregoing the present invention has been described solely in connection with illustrated embodiments thereof. Since many variations and modifications of the present invention will now be obvious to those skilled in the art it is preferred to be bound not by the specific disclosures herein contained but only by the appended claims.

The embodiments of the invention in which an exclusive privilege or property is claimed are defined as follows:

1. A thermostat comprising a base; a stud carried by said base; a cover rotatably mounted on said stud and substantially parallel to said base; a thermally responsive member carried by said cover; a mercury switch mounted within said cover, said mercury switch being angularly movable with respect to said cover; a connection between said thermally responsive member and said mercury switch; the angular position of said switch being varied by said thermally responsive member in accordance with ambient temperature conditions; rotation of said cover with respect to said base adjusting the initial angular position of said switch; the adjusting of said initial angular position of said switch by said rotation of said cover being made with respect to gravity and requiring no stationary lubber line.

2. The thermostat of claim 1 in which said mercury switch is mounted on said thermally responsive member.

3. The thermostat of claim 1 in which said thermally responsive member and said mercury switch are carried by said cover on the side thereof facing said base.

4. The thermostat of claim 1 in which said cover is provided with a bushing rotatable on said stud and means for locking said cover to said stud.

5. The thermostat of claim 4 in which said base carries a terminal block; wire conductors extending from said mercury switch, said wire conductors being conducted to said terminal block.

6. The thermostat of claim 5 in which additional wire connections are provided at said terminal block; said wire connections being adapted for use in a circuit to be controlled.

7. The thermostat of claim 6 in which said base is provided with prongs for connection to an electrical power socket; said wire connections from said terminal block including connections to said prongs as well as connections adapted for use in a circuit to be controlled.

* * * * *